US008899346B2

(12) United States Patent
Dagenais et al.

(10) Patent No.: US 8,899,346 B2
(45) Date of Patent: Dec. 2, 2014

(54) PERFORATING ASSEMBLY CONTROL

(71) Applicant: Halliburton Energy Services, Inc., Houston, TX (US)

(72) Inventors: Pete C. Dagenais, The Colony, TX (US); Michael L. Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/921,097

(22) Filed: Jun. 18, 2013

(65) Prior Publication Data

US 2014/0102788 A1 Apr. 17, 2014

Related U.S. Application Data

(63) Continuation of application No. PCT/US2012/060518, filed on Oct. 17, 2012.

(51) Int. Cl.
*E21B 43/1185* (2006.01)
*E21B 43/117* (2006.01)

(52) U.S. Cl.
CPC ..... *E21B 43/117* (2013.01)
USPC ..... 175/4.56; 166/55

(58) Field of Classification Search
USPC ..... 166/55, 297; 175/4.56, 4.54
See application file for complete search history.

(56) References Cited

U.S. PATENT DOCUMENTS 2,719,485 A 10/1955 Arthur
4,319,526 A 3/1982 DerMott
5,159,145 A * 10/1992 Carisella et al. ..... 89/1.15
5,199,497 A 4/1993 Ross
5,273,116 A 12/1993 Ross
5,346,014 A * 9/1994 Ross ..... 166/297
6,032,734 A 3/2000 Telfer
6,084,403 A * 7/2000 Sinclair et al. ..... 324/221
6,186,228 B1 * 2/2001 Wegener et al. ..... 166/249
6,568,470 B2 5/2003 Goodson, Jr. et al.
6,820,693 B2 11/2004 Hales et al.
6,926,089 B2 8/2005 Goodson, Jr. et al.
7,291,028 B2 11/2007 Hall et al.
7,387,156 B2 6/2008 Drummond et al.
7,428,922 B2 9/2008 Fripp et al.
7,802,619 B2 9/2010 Hurst et al.
8,006,779 B2 8/2011 Moore et al.
8,056,618 B2 11/2011 Wagner et al.

(Continued)

FOREIGN PATENT DOCUMENTS

WO WO2013052038 A1 * 4/2013 ..... E21B 34/00

OTHER PUBLICATIONS

International Patent Application No. PCT/US2012/060518 , "International Search Report and Written Opinion", mailed Apr. 3, 2013 (9 Pages).

*Primary Examiner* — Robert E Fuller
(74) *Attorney, Agent, or Firm* — Kilpatrick Townsend & Stockton LLP

(57) ABSTRACT

A perforating assembly includes a material that can respond to a magnetic field by changing shape multiple times and causing a fire control circuit to activate and deactivate. The material may be a magnetic shape-memory alloy and can change shape when the magnetic field is removed or inverted. When the material changes shape, the material can cause another component of the perforating assembly to change position to activate or deactivate the fire control circuit, as desired.

18 Claims, 3 Drawing Sheets

(56) References Cited

U.S. PATENT DOCUMENTS

| | | | |
|---|---|---|---|
| 8,061,431 | B2 | 11/2011 | Moore et al. |
| 8,162,051 | B2 | 4/2012 | Strickland |
| 2007/0267195 | A1 | 11/2007 | Grigar et al. |
| 2008/0149345 | A1 | 6/2008 | Marya et al. |
| 2011/0284240 | A1 | 11/2011 | Chen et al. |
| 2012/0024528 | A1 | 2/2012 | Mytopher et al. |
| 2012/0103223 | A1 | 5/2012 | Crawford |
| 2012/0138286 | A1 | 6/2012 | Mason et al. |

* cited by examiner

PERFORATING ASSEMBLY CONTROL

CROSS-REFERENCE TO RELATED APPLICATIONS

This application is a continuation of PCT/US2012/060518, filed Oct. 17, 2012, the entirety of which is incorporated herein by reference.

TECHNICAL FIELD OF THE INVENTION

The present invention relates generally to controlling a perforating assembly to be located in a wellbore and, more particularly (although not necessarily exclusively), to a material responsive to a magnetic field for changing shape multiple times and causing the perforating assembly to activate and deactivate.

BACKGROUND

Various devices can be installed in a well traversing a hydrocarbon-bearing subterranean formation. One example is a perforating assembly, such as a tubing conveyed perforating ("TCP") gun. A TCP gun can be conveyed using tubing, drillpipe or coiled tubing and include explosive charges or other mechanisms that can perforate oil and gas wells.

A perforating assembly can include a safeguard mechanism to prevent the perforating assembly from firing unintentionally. For example, the safeguard mechanism can provide an interrupt to deactivate the firing mechanism by preventing a charge train from causing a charge to explode. The safeguard mechanism can activate the firing mechanism after the perforating assembly is run downhole. The safeguard mechanism can activate the firing mechanism in response to the temperature in the wellbore causing a solder to melt, resulting in a contact to allow the charge train to travel through the perforating assembly. Other safeguard mechanisms can activate the firing mechanism in response to high pressure in the wellbore.

Although these safeguard mechanisms are effective, some wellbores include long, shallow, and/or horizontal bores in which the difference in temperature and pressure with respect to the surface is small. The temperature or pressure threshold at which these safeguard mechanisms activate the firing mechanism may be closer to a theoretical possible range of temperatures or pressures at the surface.

Furthermore, these safeguard mechanisms may not include a way to deactivate the firing mechanism if and when the perforating assembly is retrieved from the wellbore back to the surface.

Accordingly, assemblies and devices are desirable that can provide additional safety for perforating assemblies run downhole and/or brought back to the surface.

SUMMARY

Certain aspects of the present invention are directed to a perforating assembly that includes a material that can change shape multiple times in response to magnetic fields to activate and deactivate a fire control circuit of the perforating assembly.

One aspect relates to a perforating assembly that can be positioned in a wellbore traversing a subterranean formation. The perforating assembly includes a fire control circuit and a material. The material can change shape multiple times in response to a magnetic field for causing the fire control circuit to activate and deactivate.

In some examples, the material includes a magnetic shape-memory alloy.

In some examples, the perforating assembly is a tubing conveyed perforating gun.

In some examples, the material can change shape in response to the magnetic field that is proximate to a wellhead of the wellbore.

In some examples, the material can change shape in response to the magnetic field that is from a stationary device.

In some examples, the fire control circuit is an initiator mechanism or a propagation mechanism for a charge in the perforating assembly.

In some examples, the perforating assembly includes a housing and a control device. The housing defines a chamber in which the fire control circuit is located. The fire control circuit includes an upper portion and a lower portion. The control device is in the chamber between the upper portion and the lower portion. The control device includes the material.

In some examples, the control device includes a control device housing, a contact element, and a spring. The control device housing includes a body and a housing cap that cooperate to define a device chamber. The contact element is in the device chamber and extends through the housing cap. The spring is in the device chamber. The spring can bias the contact element. The material is in the device chamber between an end of the contact element and a bottom portion of the body.

In some examples, the fire control circuit in an activated configuration can allow a signal or command to cause a charge in the perforating assembly to explode. The fire control circuit in the deactivated configuration can prevent the signal or command from causing the charge to explode.

Another aspect relates to a control device for a perforating assembly that is positionable in a wellbore traversing a subterranean formation. The control device includes a non-magnetic housing, a contact element, and a material. The non-magnetic housing includes a body and a housing cap that cooperate to define a device chamber, where at least a part of the housing is non-magnetic but it does not require all of the components to be non-magnetic. The contact element is partially in the device chamber and extends through the housing cap. The material is in the device chamber. The material can change shape multiple times for causing the control device to activate and deactivate the perforating assembly in response to a magnetic field by causing a change in position of the contact element.

In some examples, the contact element in an activation configuration of the control device can extend outside the housing cap. The contact element extended outside the housing cap can link an upper portion to a lower portion of a fire control circuit for allowing a signal or command to cause a charge to explode.

In some examples, the contact element in a deactivation configuration of the control device can extend through and within the housing cap. The contact element extending within the housing cap is configured for allowing a gap between the upper portion and the lower portion of the fire control circuit for preventing the signal or command from causing the charge to explode.

In some examples, the control device includes a spring in the device chamber. The spring can bias the contact element.

In some examples, the material is adapted to cause the control device to activate by expanding and causing the contact element to overcome a biasing force of the spring and to extend outside of the housing cap. The material is adapted to cause the control device to deactivate by reducing in size and allowing the spring to bias the contact element in a direction that is away from the housing cap.

Another aspect relates to a well system that includes a wellhead, a source of a magnetic field proximate to the wellhead, and a perforating assembly. The wellhead is for a wellbore traversing a subterranean formation. The perforating assembly can be positioned in the wellbore. The perforating assembly includes a material that is adapted to change shape multiple times for causing the perforating assembly to activate and deactivate in response to a magnetic field from the source.

In some examples, the source of the magnetic field is within ten feet of the wellhead.

These illustrative aspects and examples are mentioned not to limit or define the invention, but to provide examples to aid understanding of the inventive concepts disclosed in this disclosure. Other aspects, advantages, and features of the present invention will become apparent after review of the entire disclosure.

DETAILED DESCRIPTION

Certain aspects and features relate to a perforating assembly that includes a material that is configured to respond to a magnetic field by changing shape multiple times to cause a fire control circuit to activate and deactivate. The material may be a magnetic shape-memory alloy, such as nickel manganese gallium alloy, that can change shape when exposed to a magnetic field. The material can also change shape when the field is removed or inverted. Changing shape can include the material increasing or decreasing in size, volume, or other parameter, or changing position. When the material changes shape, the material can cause another component of the perforating assembly to change position to activate or deactivate the fire control circuit, as desired. The material may be configured to change shape multiple times without the material degrading or eroding.

In some aspects, the magnetic field is from a device that is stationary and is located proximate to a wellhead of a wellbore. The device can be located proximate to the wellhead by being on or attached to the wellhead, or relatively near the wellhead, such as, for example, ten feet above or below the wellhead. As the perforating assembly is run downhole, the material passes through the magnetic field and can respond to it by changing shape and activating the fire control circuit to allow charges in the perforating assembly to be exploded, preferably at a later desired time in response to signals or other command from the surface. As the perforating assembly is brought back to the surface, the material passes through an inverted magnetic field and can respond to it by changing shape again and deactivating the fire control circuit to prevent charges in the perforating assembly from exploding.

The fire control circuit may be an initiator mechanism, a propagation mechanism, a delay timer, or another type of mechanism that can control whether a charge can explode.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present invention.

Figure 1:
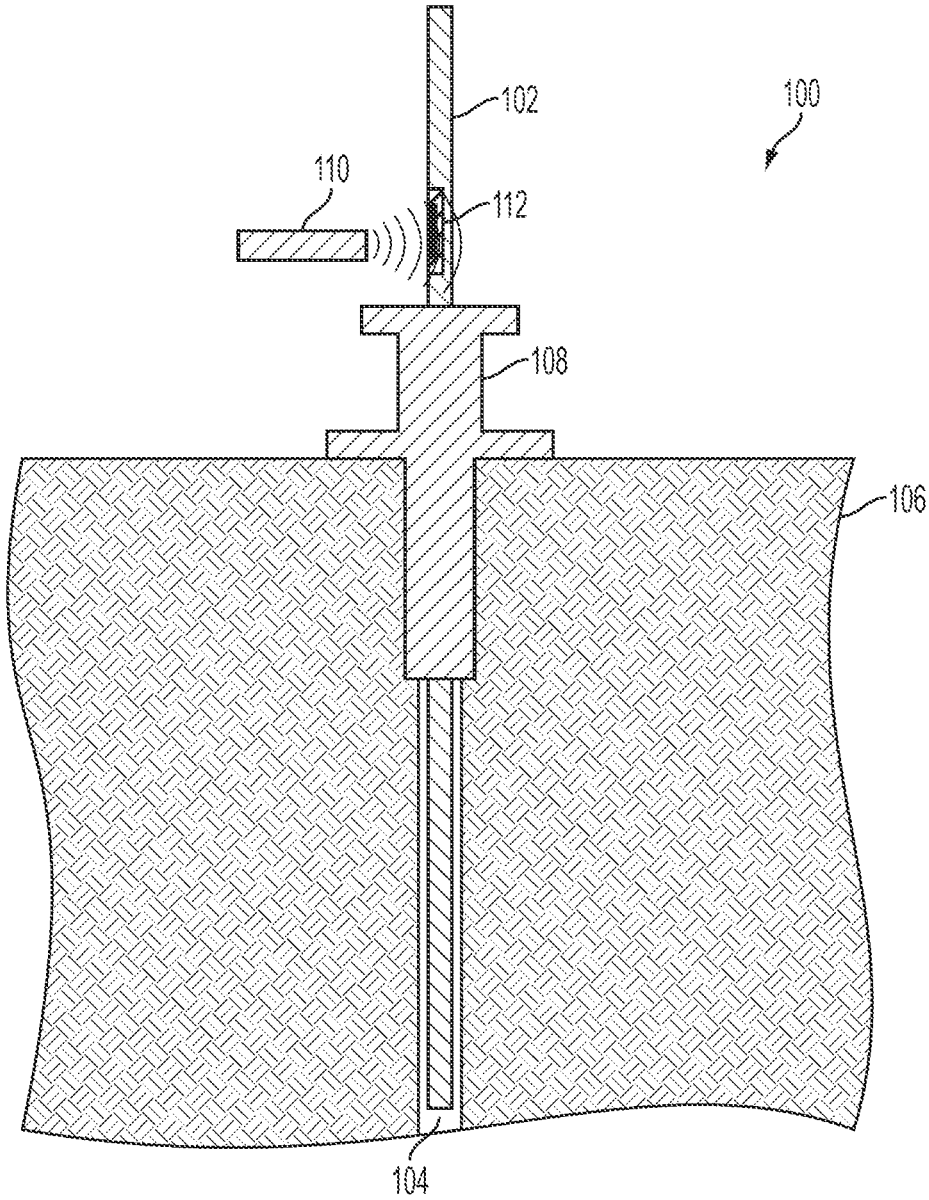
FIG. 1 is a cross-sectional view of a well system that includes a perforating assembly with material according to one aspect of the present invention.

FIG. 1 depicts a well system 100 with a perforating assembly 102 according to certain aspects of the present invention. The well system 100 includes a bore 104 traversing a subterranean formation 106 and a wellhead 108 at the surface of the bore 104. A device 110 is detached from the wellhead 108, but stationary with respect to the wellhead 108. The device 110 can provide a magnetic field.

The perforating assembly 102 includes a material 112 that can respond to the magnetic field by changing shape and causing a fire control circuit in the perforating assembly 102 to activate or deactivate. For example, the material 112 can respond to the magnetic field as the perforating assembly 102 is run downhole into the bore 104 by activating the fire control circuit to allow a charge to explode upon command or otherwise and can respond to the magnetic field as the perforating assembly 102 is retrieved from the bore 104 by deactivating the fire control circuit to prevent the charge from exploding.

The device 110 may be a permanent magnet or electromagnet that can provide the magnetic field. In some aspects, the device 110 includes two magnets that provide magnetic fields that are inverted with respect to each other. The magnets can be controlled such that one magnet provides a magnetic field when the perforating assembly 102 is run into the bore 104 while the other magnet is off—i.e. not providing a magnetic field—and the one magnet is off, but the other magnet provides an inverted magnetic field, when the perforating assembly 102 is retrieved from the bore 104.

The perforating assembly 102 in FIG. 1 is a tubing conveyed perforating ("TCP") assembly, but other types of perforating assemblies, including assemblies that can be lowered on wireline, pumped in the well, or flowed into the well, can be used. The material 112 in FIG. 1 is an MSM alloy, but other types of magnetically responsive materials that can change shape can be used. Examples of other types of magnetically responsive materials include a permanent magnet, ferromagnetic material, magnetostrictor, such as a terfenol-D alloy.

In other aspects, the perforating assembly 102 can be run into the bore 104 in a deactivated configuration. The device 110 can be positioned in a collar at a position that is at or near a designated perforation zone within the bore 104. The material 112 can respond to the magnetic field by changing size and causing the fire control circuit to change to an activated configuration when the perforating assembly 102 arrives at the designed perforation zone. In still other aspects, the device 110 can be dropped or pumped to the location of the perforating assembly 102 within the bore 104 to activate or deactivate the perforating assembly 102.

Figure 2:
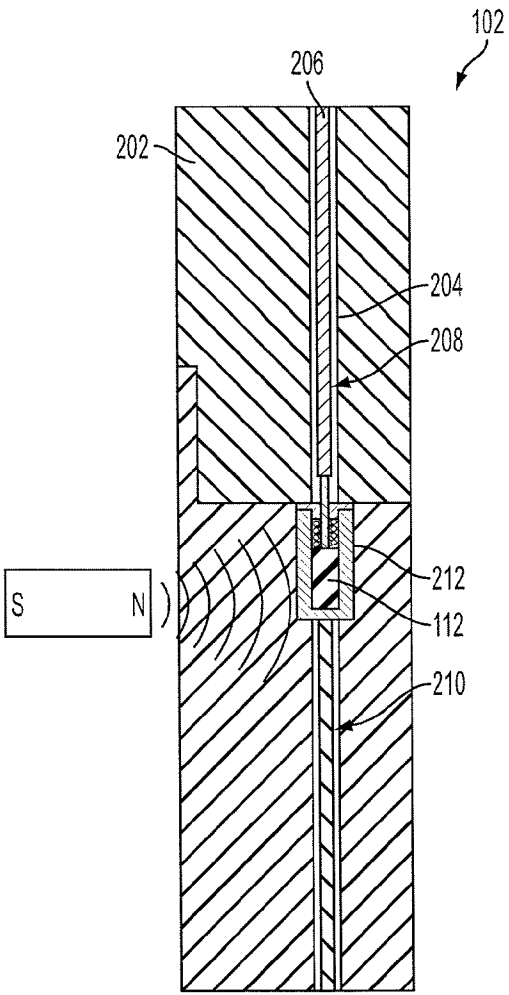
FIG. 2 is a cross-sectional view of part of a perforating assembly in an activated configuration that includes a control device with material according to one aspect of the present invention.

FIG. 2 depicts by cross-section part of the perforating assembly 102 in an activated configuration according to some aspects. The perforating assembly 102 includes a body 202 defining a chamber 204 in which is located a fire control circuit 206. The body 202 may be made of metal, such as a non-magnetic metal. The fire control circuit 206 may be a wire, detonating cord, metal linkage for percussive-type control, or other conductor.

The fire control circuit 206 includes an upper portion 208 and a lower portion 210. Located between the upper portion 208 and the lower portion 210 and in the chamber 204 is a control device 212 that includes the material 112. The material 112 can respond to a magnetic field by changing shape and causing the control device 212 to provide a link between the upper portion 208 and the lower portion 210 to activate the fire control circuit 206. For example, the perforating assembly 102 in FIG. 2 may be being run into a wellbore and the source of the magnetic field may be located proximate to the wellhead of the wellbore. In response to the magnetic field, the material 112 can change shape such that a charge train, or other signal or command, can travel between the upper portion 208 and the lower portion 210.

Figure 3:
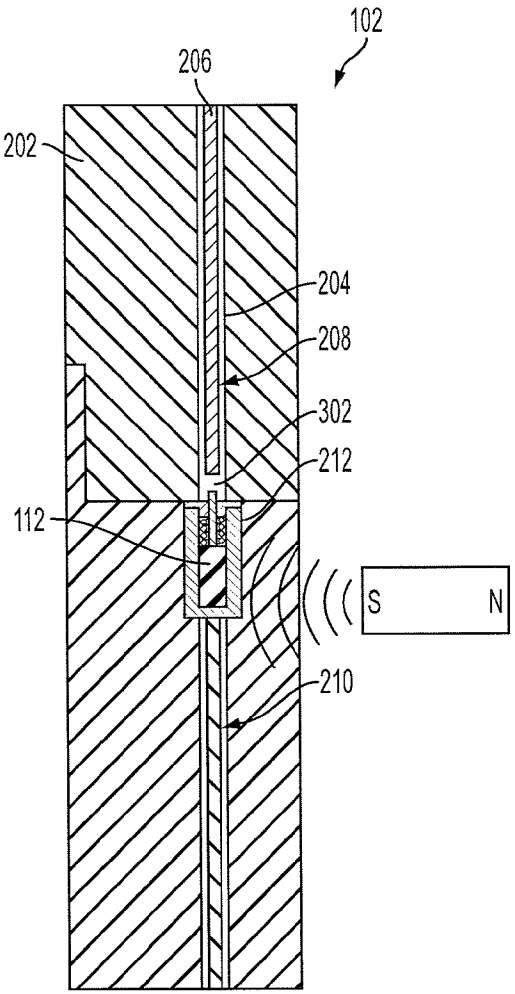
FIG. 3 is a cross-sectional view of part of a perforating assembly in a deactivated configuration that includes a control device with material according to one aspect of the present invention.

FIG. 3 depicts by cross-section the perforating assembly 102 in a deactivated position according to some aspects. The material 112 can respond to an inverted magnetic field, as shown in FIG. 3 in comparison to the magnetic field in FIG. 2, by changing shape and causing the control device 212 to delink the upper portion 208 from the lower portion 210 such that the fire control circuit 206 is unable to carry a signal or command to a charge to explode. For example, the control device 212 can cause a gap 302 to be created in the fire control circuit 206 between the upper portion 208 and the lower portion 210 to delink the upper portion 208 and the lower portion 210 and prevent a charge train, or other signal or command, from traveling between the upper portion 208 and the lower portion 210.

Figure 4:
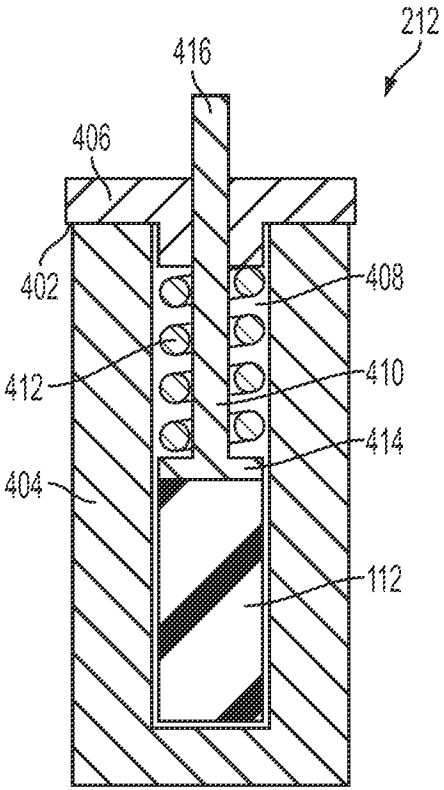
FIG. 4 is a cross-sectional view of a control device in an activated configuration that includes material according to one aspect of the present invention.

FIG. 4 is a cross-sectional view of the control device 212 in the activated configuration according to some aspects. The control device 212 includes a housing 402 that has a body 404 and a housing cap 406 coupled to the body 404. At least part of the housing 402 may be made from a non-magnetic material. The housing 402 defines a device chamber 408 in which is located the material 112, a contact element 410, and a spring 412. The contact element 410 includes an end 414 and an elongated member 416 that extends through the housing cap 406. The end 414 contacts the material 112. An example of the contact element 410 is a contact plunger.

The spring 412 is located between the end 414 and the housing cap 406. The spring 412 can normally bias the contact element 410 away from the housing cap 406.

The material 112 is located between the end 414 of the contact element 410 and a bottom part of the housing body 404. In the activated configuration, such as in response to a magnetic field, the material 112 can change shape by expanding or moving towards the housing cap 406. Material 112 expanding or moving towards the housing cap 406 can overcome the biasing force of the spring 412 to cause the end of the contact element 410 to move toward the housing cap 406 and the elongated member 416 to extend from the control device 212. The elongated member 416 extended from the control device 212 can provide a link for a fire control circuit to allow a signal or command to be carried to a charge to cause the charge to explode.

Figure 5:
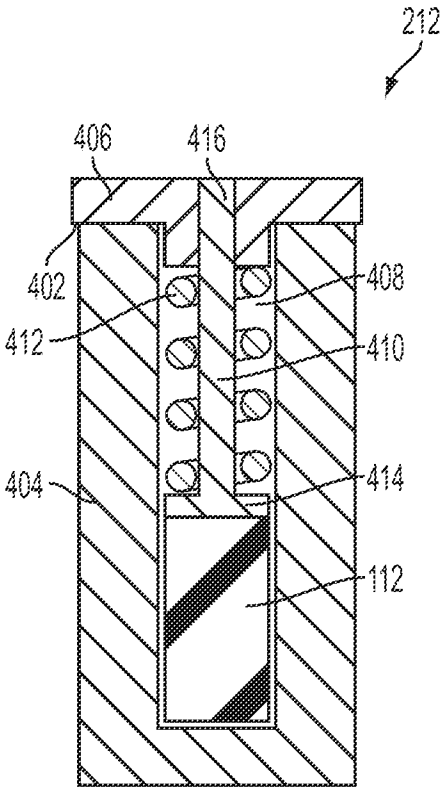
FIG. 5 is a cross-sectional view of a control device in a deactivated configuration that includes material according to one aspect of the present invention.

FIG. 5 is a cross-sectional view of the control device 212 in a deactivated configuration according to some aspects. In the deactivated position, the material 112 can respond to a magnetic field by changing shape to be smaller or otherwise to move away from the housing cap 406. The material 112 being smaller or moving away from the housing cap 406 can allow the spring 412 to move the end 414 away from the housing cap 406 and the elongated member 416 from extending outside the control device 212. The elongated member 416 moved from extending outside the control device 212 can delink an upper portion of a fire control circuit from a lower portion such that no signal or command can be carried to a charge to cause the charge to explode.

The material 112 can change shape multiple times in response to the magnetic fields so that a perforating assembly can be activated and deactivated, and activated and/or deactivated multiple times.

In some aspects, the housing body 404 includes a window through which a magnetic field may more easily pass. The window may be absent of material or include a different material than the material from which the housing body 404 is made. In aspects including the window, the housing body 404 may be made from a magnetic material.

Various aspects provide a safe and reliable mechanism by which a perforating assembly such as a TCP gun can be kept inactive until desired, even in relatively shallow wellbores.

The foregoing description of the aspects, including illustrated aspects, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A perforating assembly positionable in a wellbore traversing a subterranean formation, the perforating assembly comprising:

a fire control circuit;

a material adapted to change shape multiple times in response to a magnetic field for causing the fire control circuit to activate and deactivate, the material being a magnetic shape-memory alloy;

a housing in which is defined a chamber, wherein the fire control circuit is located in the chamber, the fire control circuit comprising an upper portion and a lower portion; and a control device located in the chamber between the upper portion and the lower portion, the control device comprising the material.

2. The perforating assembly of claim 1, wherein the perforating assembly is a tubing conveyed perforating gun.

3. The perforating assembly of claim 1, wherein the magnetic field is proximate to a wellhead of the wellbore.

4. The perforating assembly of claim 1, wherein the material is adapted to change shape in response to the magnetic field that is from a stationary device.

5. The perforating assembly of claim 1, wherein the fire control circuit is an initiator mechanism or a propagation mechanism for a charge in the perforating assembly.

6. The perforating assembly of claim 1, wherein the control device comprises:

a control device housing comprising a body and a housing cap that cooperate to define a device chamber;

a contact element in the device chamber and extending through the housing cap; and a spring in the device chamber, the spring being adapted for biasing the contact element, wherein the material is in the device chamber between an end of the contact element and a bottom portion of the body.

7. The perforating assembly of claim 1, wherein the fire control circuit in an activated configuration is adapted for allowing a signal or command to cause a charge in the perforating assembly to explode, wherein the fire control circuit in a deactivated configuration is adapted for preventing the signal or command from causing the charge to explode.

8. A control device for a perforating assembly that is positionable in a wellbore traversing a subterranean formation, the control device comprising:

a non-magnetic housing comprising a body and a housing cap that cooperate to define a device chamber;

a contact element partially in the device chamber and extending through the housing cap; and a material in the device chamber, the material being adapted to change shape multiple times for causing the control device to activate and deactivate the perforating assembly in response to a magnetic field by causing a change in position of the contact element, wherein the control device is located with a fire control circuit in a chamber, the fire control circuit includes an upper portion and a lower portion, the chamber being defined by a housing, the control device being located in the chamber between the upper portion and the lower portion.

9. The control device of claim 8, wherein the material comprises a magnetic shape-memory alloy.

10. The control device of claim 8, wherein the magnetic field is proximate to a wellhead of the wellbore.

11. The control device of claim 8, wherein the contact element in an activation configuration of the control device is adapted to extend outside the housing cap, wherein the contact element extended outside the housing cap is configured for linking the upper portion to the lower portion of the fire control circuit for allowing a signal or command to cause a charge to explode.

12. The control device of claim 11, wherein the contact element in a deactivation configuration of the control device is adapted to extend through and within the housing cap, wherein the contact element extending within the housing cap is configured for allowing a gap between the upper portion and the lower portion of the fire control circuit for preventing the signal or command from causing the charge to explode.

13. The control device of claim 8, further comprising:

a spring in the chamber, the spring being configured for biasing the contact element.

14. The control device of claim 13, wherein the material is adapted to cause the control device to activate by expanding and causing the contact element to overcome a biasing force of the spring and to extend outside of the housing cap, wherein the material is adapted to cause the control device to deactivate by reducing in size and allowing the spring to bias the contact element in a direction that is away from the housing cap.

15. A well system, comprising:

a wellhead for a wellbore traversing a subterranean formation;

a source of a magnetic field proximate to the wellhead; and a perforating assembly positionable in the wellbore, the perforating assembly comprising:

a fire control circuit;

a material adapted to change shape multiple times for causing the perforating assembly to activate and deactivate in response to the magnetic field from the source;

a housing in which is defined a chamber, wherein the fire control circuit is located in the chamber, the fire control circuit comprising an upper portion and a lower portion; and a control device located in the chamber between the upper portion and the lower portion, the control device comprising the material.

16. The well system of claim 15, wherein the material comprises a magnetic shape-memory alloy, wherein the perforating assembly is a tubing conveyed perforating gun.

17. The well system of claim 15, wherein the control device comprises:

a control device housing comprising a body and a housing cap that cooperate to define a device chamber;

a contact element in the device chamber and extending through the housing cap; and a spring in the device chamber, the spring being adapted for biasing the contact element, the material in the device chamber between an end of the contact element and a bottom portion of the body.

18. The well system of claim 15, wherein the source of the magnetic field is within ten feet of the wellhead.

* * * * *